United States Patent [19]

Snaper

[11] 4,407,134

[45] Oct. 4, 1983

[54] AIR CONDITIONING SYSTEM

[76] Inventor: Alvin A. Snaper, 2800 Cameo Circle, Las Vegas, Nev. 89107

[21] Appl. No.: 323,054

[22] Filed: Nov. 19, 1981

[51] Int. Cl.[3] ..... F25B 9/02

[52] U.S. Cl. ..... 62/5; 55/312; 55/387

[58] Field of Search ..... 62/5; 55/312, 314, 316, 55/387, 389

[56] References Cited

U.S. PATENT DOCUMENTS

| | | | |
|---|---|---|---|
| 1,610,288 | 12/1926 | Jones et al. | 55/314 |
| 3,285,701 | 1/1966 | Robertson | 55/389 |
| 3,555,787 | 1/1971 | Lustig | 55/389 |
| 3,889,484 | 6/1975 | Vander Horst et al. | 62/5 |
| 3,899,684 | 8/1975 | Tenny | 62/5 |
| 3,942,330 | 3/1976 | Schroder | 62/5 |

*Primary Examiner*—Ronald C. Capossela
*Attorney, Agent, or Firm*—Donald D. Mon

[57] ABSTRACT

A conditioner system for air including a source of air under pressure, a vortex tube of the type which whirls air and in the process raises the temperatures of air in one region and cools it in another. The vortex tube has an inlet receiving air under pressure from the source, a hotter air outlet, and a colder air outlet. Conduit means conveys air from one of the outlets to a region to be treated by the air conveyed by the conduit means which may be hotter or colder air depending on the outlet selected.

11 Claims, 3 Drawing Figures

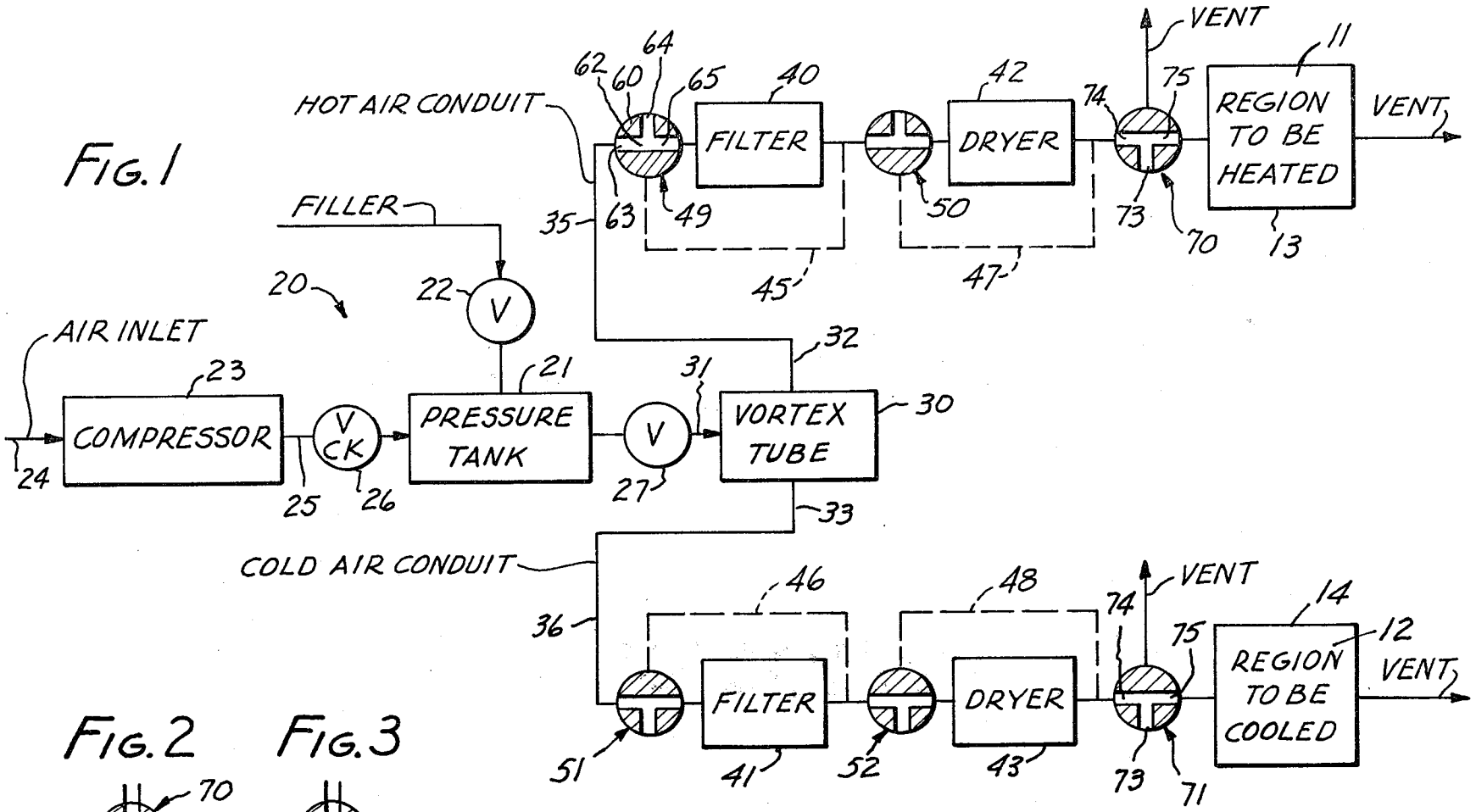
FIG. 1
FIG. 2
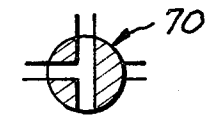
FIG. 3
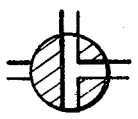

AIR CONDITIONING SYSTEM

This invention relates to conditioner systems for air which have a minimum of moving parts and of parts which require repair and replacement, and which can give an initial blast of cold air as the consequence of a discharge of quantity of stored compressed air.

Conventional air conditioning systems are primarily designed to bring an existing temperature down rather slowly, and then hold the lower temperature against a relatively low rate of heat transfer. It is a common experience in an air conditioned automobile on a hot day to endure a gradually decreasingly uncomfortably hot temperature while the air-conditioner pumps down the region inside the automobile. Conventional systems are unable to deliver a quick burst of cold air to make the automobile comfortable immediately.

It is an object of this invention to provide a means whereby energy can be stored in the form of compressed air and quickly released through a system having no moving parts that provides an initial and immediate burst of cold air which will make the automobile comfortable, after which the routine operation at a lesser rate will serve to maintain a suitable temperature.

It is another object of this invention to utilize a vortex tube as means for reducing temperature of the air, whereby both cold and hot air can be produced. The cold air or hot air may be selectively utilized, one for cooling and the other for heating. If desired, filter and dryer means may be placed in the heated and cool air conduits.

A conditioner according to this invention includes a source of air under pressure, and a vortex tube of the type which whirls air and in the process raises the temperature of air in one region and cools it in another region. The vortex tube includes an inlet receiving air under pressure from the source, a hotter air outlet discharging the hotter air and a colder air outlet discharging the colder air. Conduit means conveys air from one of said outlets to a region to be treated by the air.

According to a preferred but optional feature of this invention, the conduit means discharges air into an enclosure which is to be heated or cooled as appropriate.

The above and other features of this invention will be fully understood from the following detailed description and the accompanying drawings in which:

BRIEF DESCRIPTION OF THE DRAWINGS

FIG. 1 is a system diagram showing the presently preferred embodiment of the invention;

FIG. 2 is a showing of an alternate setting of some ofthe valves; and

FIG. 3 is a schematic showing of a third setting used in certain of the valves.

DESCRIPTION OF THE PREFERRED EMBODIMENT

In FIG. 1, there is shown an air conditioner system 10 according to the invention. It has as its function to provide conditioned air to a region 11 when heated air is to be supplied, or to a region 12 when cold air is to be supplied. It is of course possible to provide both hot and cold air to different regions simultaneously. The regions may be piles of material to be cooled or dried, stacked over diffuser plates through which the air is exhausted, or more conventionally there will be an enclosure 13, 14. An example of a heated enclosure 13 is a drying room for food. An example of a cooled enclosure 14 is the passenger compartment of an automobile. Other enclosures can of course be supplied with air instead, and it will not be infrequent for the air stream not used simply to be vented to atmosphere. Also, in an automobile arrangement, the enclosure 13 could be the same passenger compartment as enclosure 14 and system utilized selectively either to heat or to cool it. If it were used as a heater, then the cold air would be vented to atmosphere. If it were used as a cooler, the hot air would be vented.

The system includes a source 20 of air under pressure. At its simplest, it may comprise a pressure tank 21 with a filler valve 22. The tank can receive compressed air and store it until the time of use. The system will function until the stored air is exhausted. An alternative technique suitable for long-turn usage is to include in the source an air compressor 23 with an air inlet 24 from atmosphere and an outlet 25 to the pressure tank. Customarily a check valve 26 will be provided to admit the high pressure air to the pressure tank and to prevent loss from the pressure tank.

An off-on valve 27 controls exit of air under pressure from the source.

A vortex tube 30 is of the type which whirls air in a circular motion, and in the process raises the temperature of some of the air in one region and lowers the temperature of the air in another region in the vortex tube. Such vortex tubes are well known and require no specific description here. They are sometimes called "Hiltch" tubes. One well known vortex tube is the Vortex Amplifier Model V-1 manufactured by General Fluidics Corporation, 9254 Independence Avenue, Chatsworth, Calif. Although the production of different temperatures is not the primary intended use of this vortex amplifier, the device does work as a vortex tube and produces that result. In common with other such vortex tubes it includes an inlet 31 receiving pressure from the source, a hotter air outlet 32 and a colder air outlet 33. These respectively exhaust air from the hotter or cooler regions in the vortex tube.

Conduit means includes a hot air conduit 35 and a cold air conduit 36 which respectively connect to outlet 32 and 33, and convey the air therefrom. If only one service at a time is desired, a single conduit can be connected to the appropriate outlet.

If the pressure tank contains compressed air, or if a compressor supplies air under pressure straight through the pressure tank or an open line and through the open off-on valve 27 to the vortex tube, the movement of the air in the vortex tube will cause hot air to flow from outlet 32 through conduit 35, and cold air from outlet 33 through conduit 36. The air in these respective conduits can be wherever hot or cold air performs a desired function.

It may be desirable to treat the air, especially the colder air, to remove particulate matter and moisture therefrom. Accordingly, optional filter means 40, 41 is provided in the hot and cold air conduits. Dryer means 42, 43 are optionally also included in conduits 35 and 36. In the event that these functions are not desired, by-pass means 45, 46, 47, 48, is provided respectfully and selectively to by-pass the filters and the dryers. The by-pass means respectively include by-pass valves 49, 50, 51, 52. These valves are conventional three way valves which are adapted to permit straight-through flow of air to the filter or dryer or through the by-pass means and conduits 53, 54, 55, 56 to by-pass the respective element.

Flow through the respective elements is accomplished by the setting illustrated in FIG. 1 wherein a typical valve body 60 is shown with a valve rotor. The rotor includes a T-shaped passage 62 and the valve body includes ports 63, 64, 65. In the setting shown in FIG. 1, the flow is from port 63 to port 65. In the setting shown in FIG. 2, which is the by-pass setting, the T-shaped passage inter-connects ports 63 and 64. This construction and connection is also typical for valves 49–52.

Because the operation of the vortex tube requires that air be exhausted both to the hot and the cold air outlet simultaneously, it is necessary for there to be flow through both outlets. For this purpose selector valves 70, 71 are provided for enclosures 13, 14. Because they are identical, only selector valve 70 will be described in detail. Its body 72 includes a vent port 73 and inlet and outlet ports 74, 75. The setting for the treatment of the enclosures is shown in FIG. 1. The setting of FIG. 2 will cause venting, and the setting of FIG. 3 will shut off the enclosure from the system. There is also a possible setting 45 degrees away from that of FIG. 3 where in all of the ports of the selector valves are closed. What is important is that while the vortex tube is operating, there is flow from both outlets. Of course, either or both of the enclosures can be shut off from the stream, and the air vented to atmosphere.

The operation of the system should be evident from the foregoing. An automobile as the consequence of its prior operation before shutdown may be left with a pressure tank full of compressed air. Then when heating or cooling is desired as appropriate, the off-on valve 27 is opened and the rush of air through the vortex tube will produce a blast of hot and cold air to be used as desired. Should only cooling be desired, valve 70 will be set to vent, and by-pass means 45, 47, will be set to by-pass the filter and dryer. Valve 71 will be set to supply cold air to enclosure 14, and by-pass means 46, 48 will be adjusted to direct the flow through both the filter and the dryer or through either one or the other, or neither, as appropriate to the circumstances.

This will provide an initial blast of cooling air which can cool an automobile passenger compartment very quickly. In fact, a pressure tank of perhaps two gallons capacity maintained at about 70 p.s.i.a. will nicely cool down the passenger compartment of a relatively large car in less than a minute. In the meantime, the compressor may be operated to press more air into the system, and after the first blast of cooling air, the vortex tube will continue to supply cold air at a lesser rate consistent with the heat transfer through the wall of the automobile. The opposite setting will be made when the region is to be heated. Then the cold air is to be vented. In the instance where both heating and cooling are to be done, perhaps in different regions such as drying food with the hot air, and cooling an office with the cold air, both valves 70 and 71 will be set to the illustrated condition so that both will function.

The use of an enclosure is optional but it does function to conserve the heat or cold, as compared to simply diffusing the air through a pile of material, or into an open region.

Filters when used may be of any type suited to the material to be removed. Preferrably they cause only a relatively small pressure drop. Microporous filters are well known and are useful for such a purpose. For the dryer means, silica gel is useful, and has the advantage that it can be regenerated.

Well known vortex tubes generally produce about 90% cold air and about 10% hot air with a temperature differential of about plus (+) 100° F. for the hot and about minus 80° F. for the cold. Both of these differentials are measured from the ambient incoming air temperature.

This invention is not to be limited by the embodiment shown in the drawings and described in the description, which is given by way of example and not of limitation, but only in accordance with the scope of the appended claims.

I claim:

1. A conditioner system for air comprising: a source of air under pressure, said source comprising a compressor and a pressure tank having an inlet and an outlet, valve means to admit air under pressure, and valve means adapted to hold air in said tank or to release it to the inlet of the vortex tube; a vortex tube of the type which whirls air and in the process raises the temperature of the air in one region and cools it in other regions, said vortex tube including an inlet receiving air under pressure from said source, a hotter air outlet discharging the hot air from one region and a colder air outlet discharging the colder air from the other region; and a conduit means for conveying air from one of said outlets to a region to be treated by air conveyed by the conduit means from the respective outlet; valve means for selectively directing hot, cold or hot and cold air to the region to be treated, whereby said region is treated with a blast of hot, cold or hot and cold air as a result of releasing air flow, said pressure tank to rapidly heat or cool said treated region.

2. A conditioner according to claim 1 including an enclosure containing said region to be treated, the conduit means discharging into said enclosure.

3. A conditioner according to claim 1 in which filter means is incorporated in said conduit means for removing particulate matter from the air stream.

4. A conditioner according to claim 3 in which by-pass means including a selector valve is provided in said conduit means selectively to by-pass said filter means.

5. A conditioner according to claim 3 including an enclosure containing said region, to be treated the conduit means discharging into said enclosure.

6. A conditioner according to claim 1 in which dryer means is incorporated into said conduit but means for removing moisture from the air stream.

7. A conditioner assembly according to claim 6 in which filter means is incorporated in said conduit means for removing particulate matter from the air stream.

8. A conditioner according to claim 7 in which by-pass means including a selector valve is provided in said conduit acrss each of said filter means and dryer means, whereby selectively to by-pass said filter means and said dryer means.

9. A conditioner according to claim 6 in which by-pass means including a selector valve is provided in said conduit means selectively to by-pass said dryer means.

10. A conditioner according to claim 9 in which by-pass means including a selector valve is provided in said conduit means selectively to by-pass said filter means.

11. A conditioner according to claim 6 including an enclosure containing said region, to be treated the conduit means discharging into said enclosure.

* * * * *